US008919671B2

(12) United States Patent
Yu

(10) Patent No.: US 8,919,671 B2
(45) Date of Patent: Dec. 30, 2014

(54) SHOWER HEAD

(75) Inventor: Zhangjun Yu, Zhangzhou (CN)

(73) Assignee: Sinyu Technology (Fujian) Co., Ltd., Zhangzhou, Fujian (CN)

( * ) Notice: Subject to any disclaimer, the term of this patent is extended or adjusted under 35 U.S.C. 154(b) by 101 days.

(21) Appl. No.: 13/877,705

(22) PCT Filed: Mar. 4, 2011

(86) PCT No.: PCT/CN2011/071529
§ 371 (c)(1),
(2), (4) Date: Apr. 4, 2013

(87) PCT Pub. No.: WO2012/048548
PCT Pub. Date: Apr. 19, 2012

(65) Prior Publication Data

US 2013/0193238 A1 Aug. 1, 2013

(30) Foreign Application Priority Data

Oct. 13, 2010 (CN) ..... 2010 2 0571199 U

(51) Int. Cl.

| | |
|---|---|
| ***B05B 1/18*** | (2006.01) |
| ***B05B 1/12*** | (2006.01) |
| ***B05B 15/08*** | (2006.01) |
| ***B05B 1/16*** | (2006.01) |
| ***E03C 1/04*** | (2006.01) |
| *B05B 3/04* | (2006.01) |
| *B05B 15/06* | (2006.01) |
| *B05B 7/04* | (2006.01) |

(52) U.S. Cl.
CPC ..... *B05B 1/185* (2013.01); *B05B 1/1627* (2013.01); *E03C 1/0409* (2013.01); *B05B 1/18* (2013.01); *B05B 3/04* (2013.01); *B05B 15/067* (2013.01); *B05B 7/0425* (2013.01)
USPC ..... 239/447; 239/428.5; 239/446; 239/587.4

(58) Field of Classification Search
USPC ..... 239/380, 381, 383, 428.5, 436, 239/443–449, 548, 556, 558, 559, 562, 563, 239/567, 587.3, 587.4
See application file for complete search history.

(56) References Cited

U.S. PATENT DOCUMENTS

| | | | | |
|---|---|---|---|---|
| 5,690,282 | A * | 11/1997 | Guo | 239/395 |
| 2002/0003175 | A1 * | 1/2002 | Fan | 239/548 |
| 2008/0017735 | A1 * | 1/2008 | Zhou | 239/437 |
| 2011/0073678 | A1 * | 3/2011 | Qiu et al. | 239/451 |

* cited by examiner

*Primary Examiner* — Darren W Gorman

(57) ABSTRACT

A shower head includes a shower body, a spherical joint, a fixing seat, a TPR roller, a welding sheet, a switching shaft, a connecting member, a water dispensing disc, a supporting frame, an inclined member, a rotor, an air intake valve, a TPR lid, and a cover. The switching shaft is a concave body with a handle. A cylinder having a hole is provided in the concave body. A spring and a sealing gasket are sleeved on the cylinder. A pillar is arranged on the outer side of the concave body. The pillar is connected with the connecting member. The handle of the switching shaft is connected with the welding sheet. The shower head has the advantages that the sealing effect is better when the water pressure is lower, and it is easy to switch when the water pressure is higher.

7 Claims, 15 Drawing Sheets

SHOWER HEAD

BACKGROUND OF THE INVENTION

1. Field of the Invention

The present invention relates to a shower head structure, and more particularly to a shower head.

2. Description of the Prior Art

A conventional multi-functional shower head uses a switch roller for switch function. Because the diameter of the shower head panel is larger, it is strenuous to switch and it is difficult for the user to switch the roller with one hand. Accordingly, the inventor of the present invention has devoted himself based on his many years of practical experiences to solve these problems.

SUMMARY OF THE INVENTION

The primary object of the present invention is to provide a shower head which is convenient for the user to operate it with one hand.

In order to achieve the aforesaid object, the shower head of the present invention comprises a shower head body, a spherical joint, a fixing seat, a TPR (Thermoplastic Rubber) roller, a welding sheet, a switching shaft, a connecting member, a water dispensing disc, a supporting frame, an inclined member, a rotor, an air intake valve, a TPR lid and a cover. The switching shaft is a concave body with a handle. A cylinder having a hole is provided in the concave body. A spring and a sealing gasket are sleeved on the cylinder. A pillar is arranged on the outer side of the concave body. The pillar is connected with the connecting member. The handle of the switching shaft is connected with the welding sheet.

Preferably, the sealing gasket is a cylinder having a recess to receive a small cylinder. The spring is disposed in the recess. The small cylinder is mated with the hole of the cylinder on the switching shaft. The top of the welding plate communicates with the fixing seat. One side of the bottom of the welding plate is connected with the switching shaft, and the other side is connected with the TPR roller. The rotating width of one side of the TPR roller is 40 degrees. The connecting member has left and right through holes and a middle blind hole, and the two through holes communicate with the water dispensing disc.

Preferably, the cover has a central air inhaling hole. The supporting frame has a plurality of notches around an inner edge thereof. The inclined member has an air passage. The notches communicate with the air passage to form an air inhaling passage of the shower head. Preferably, the TPR lid has two air inhaling holes thereon. The TPR lid has a plurality of air intake passages at a lower surface thereof to communicate with the two air inhaling holes. A gap is defined between the air intake valve the TPR lid to form an air chamber as an air inhaling passage for massage water.

Because the roller is applied to the shower head to rotate the switching shaft, and the spring and the sealing gasket are arranged on the switching shaft, and the sealing gasket blocks water-dividing holes to divide water when the roller rotates. The shower head has the advantages that the sealing effect is better when the water pressure is lower, and it is easy to switch when the water pressure is higher.

The roller used to switch the functions of the shower head is disposed at one side of the shower head panel. It is very convenient for the user to operate with one hand.

The present invention has an air inhaling function to provide bubble water containing oxygen, massage water, bubble mixing water, and so on for selection. It is convenient for the user to operate the shower head, and the user will feel comfortable when taking a shower.

BRIEF DESCRIPTION OF THE DRAWINGS

FIG. 4-1 and FIG. 4-2 are schematic views to show the water dispensing disk seen from different angles;

FIG. 5-1 and FIG. 5-2 are schematic views to show the connecting member seen from different angles;

FIG. 6-1 and FIG. 6-2 are schematic views to show the welding sheet seen from different angles;

FIG. 7-1 and FIG. 7-2 are schematic views to show the switching shaft seen from different angles;

FIG. 8-1 and FIG. 8-2 are schematic views to show the sealing gasket seen from different angles;

FIG. 9-1 and FIG. 9-2 are schematic views to show the water passage of the shower head of the present invention;

FIG. 10-1 and FIG. 10-2 are schematic views to show the water passage of the massage water of the present invention;

FIG. 11-1 and FIG. 11-2 are schematic views to show the air inhaling passage of the shower head water of the present invention;

FIG. 11-3 is an enlarged view of FIG. 11-2;

FIG. 13-1 and FIG. 13-2 are schematic views to show the supporting frame seen from different angles;

FIG. 14-1 and FIG. 14-2 are schematic views to show the cover seen from different angles;

FIG. 14-3 is a sectional view of the cover;

FIG. 15-1 is a schematic view to show the air inhaling passage of massage water;

FIG. 15-2 is an enlarged view of FIG. 15-1;

FIG. 17-1 is a schematic view to show the bottom of the TPR lid; and

FIG. 17-2 is a schematic view to show the top of the TPR lid.

DETAILED DESCRIPTION OF THE PREFERRED EMBODIMENTS

Embodiments of the present invention will now be described, by way of example only, with reference to the accompanying drawings.

Figure 1:
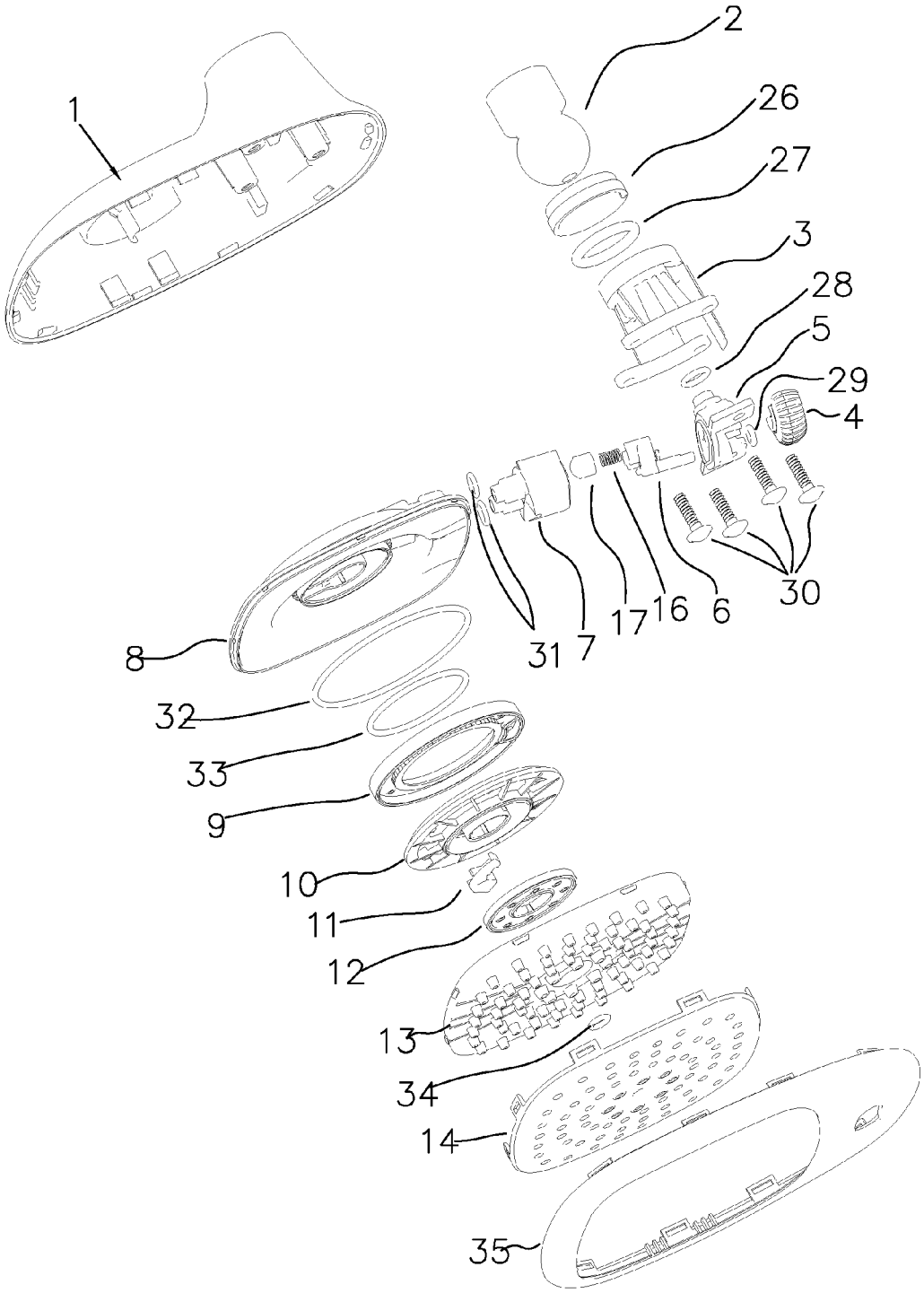
FIG. 1 is an exploded view of the present invention.
Figure 2:
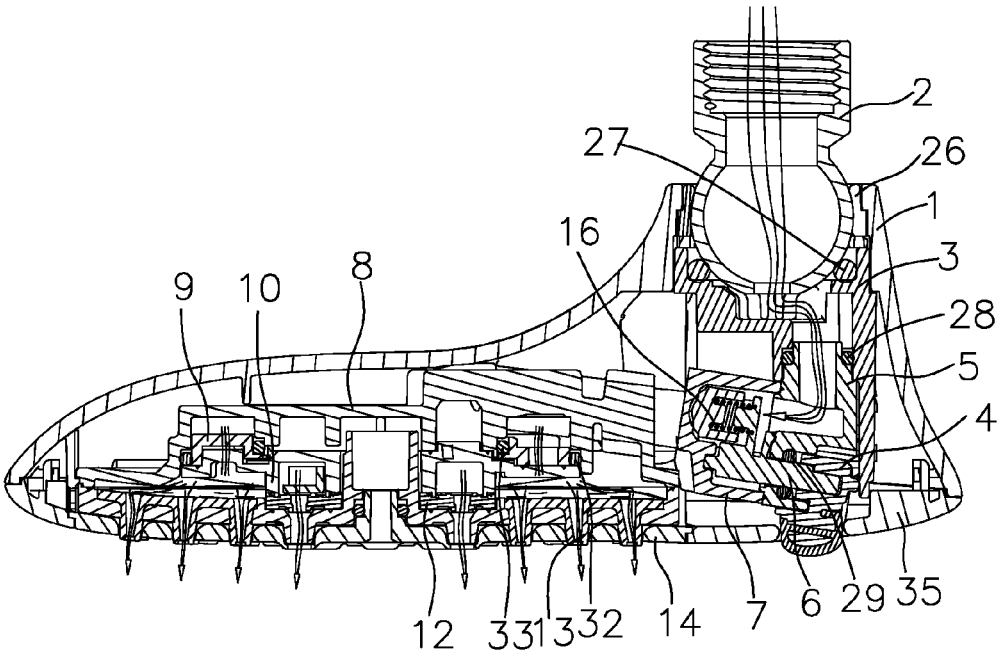
FIG. 2 is a sectional view of the present invention.
Figure 3:
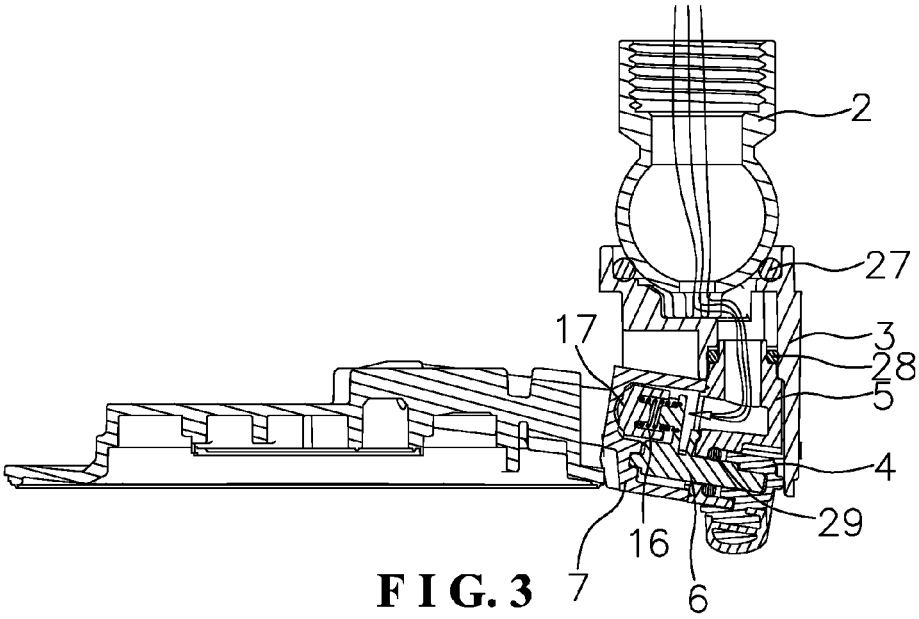
FIG. 3 is a partial sectional view of the present invention.
Figures 1, 4:
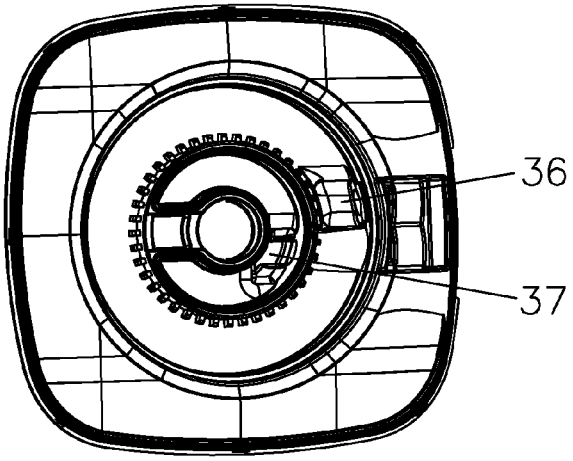
Figures 2, 4:
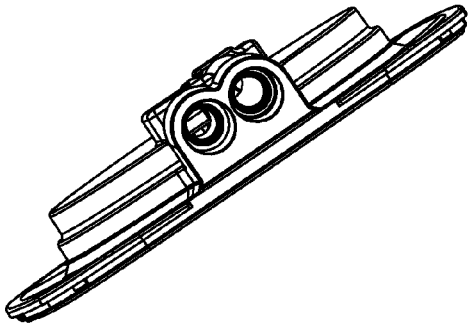
Figures 1, 5:
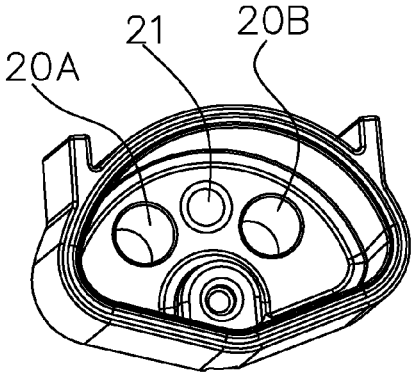
Figures 2, 5:
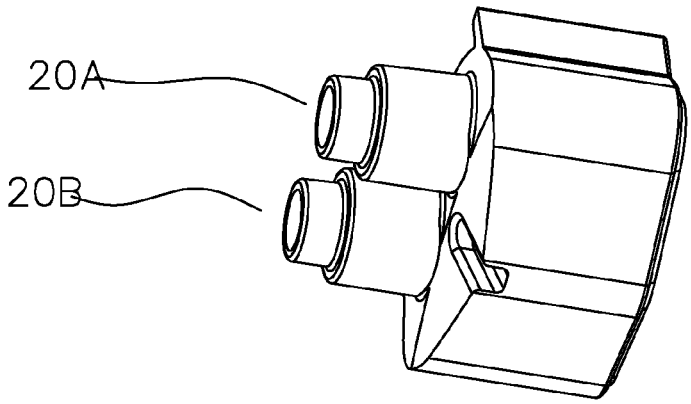
Figures 1, 6:
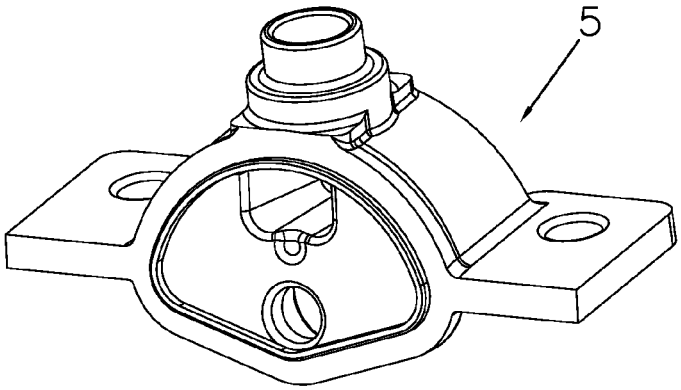
Figures 2, 6:
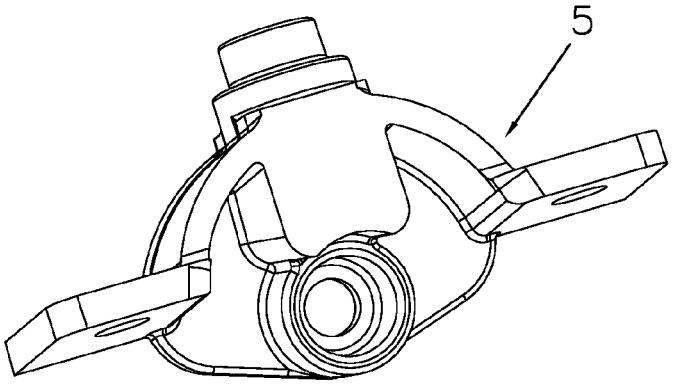
Figures 1, 7:
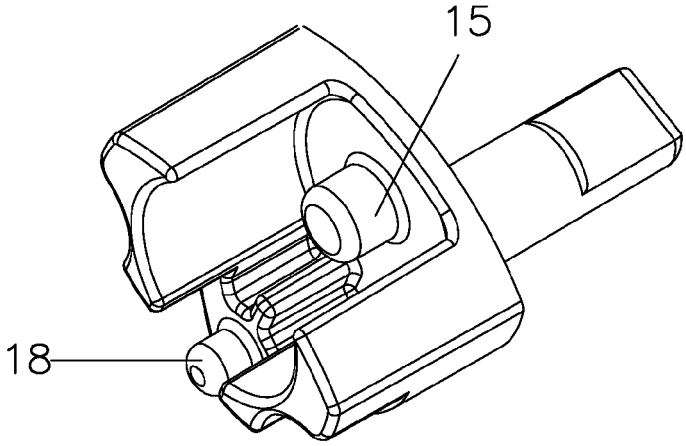
Figures 2, 7:
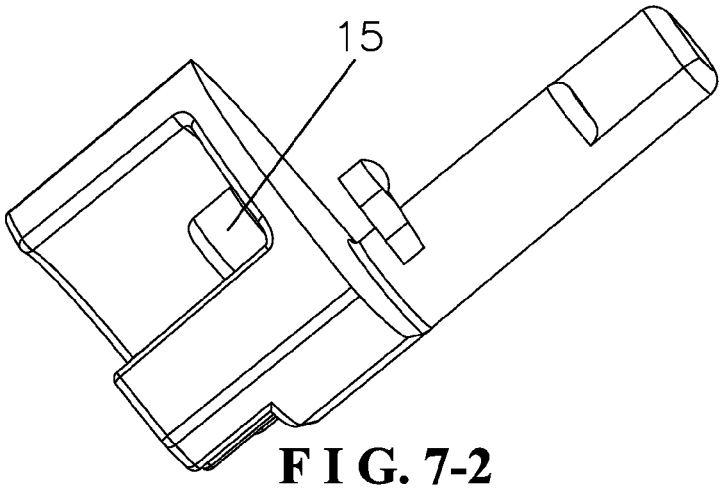
Figures 1, 8:
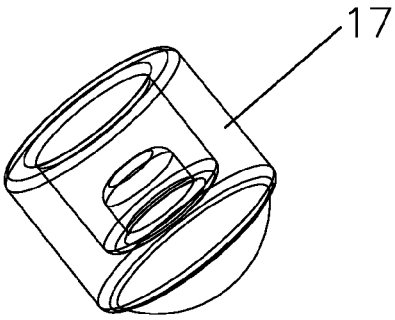
Figures 2, 8:
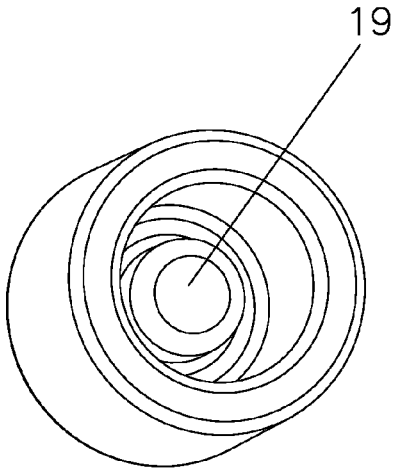
Figures 1, 9:
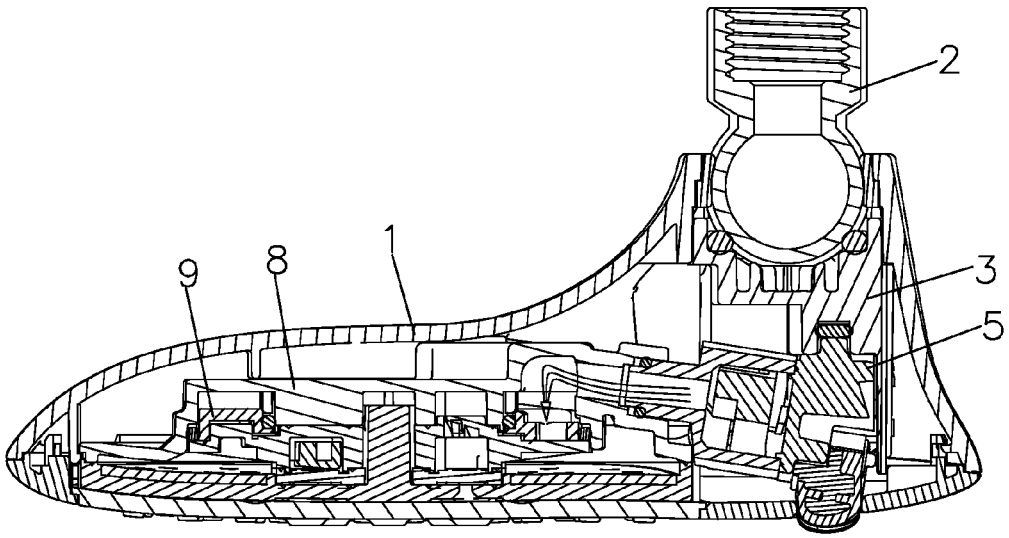
Figures 2, 9:
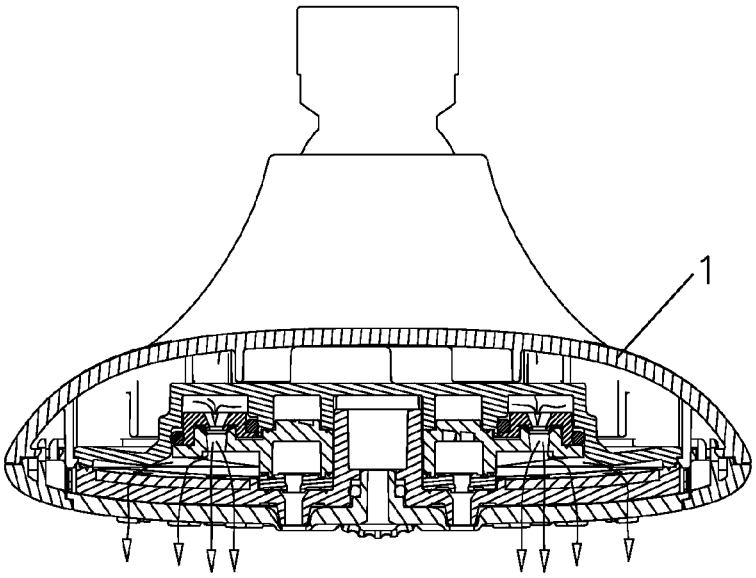
Figures 1, 10:
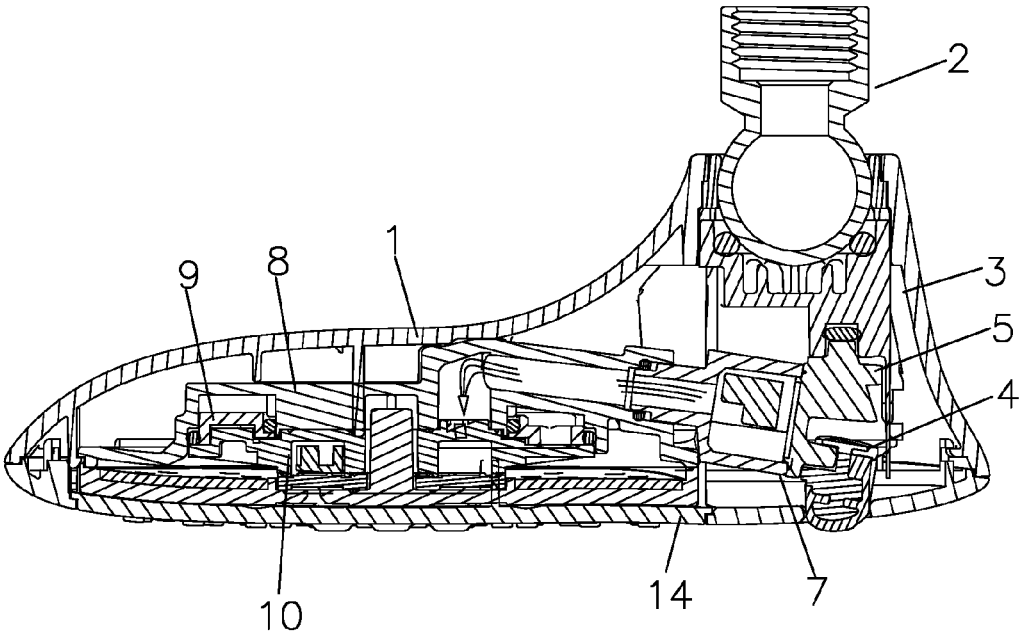
Figures 2, 10:
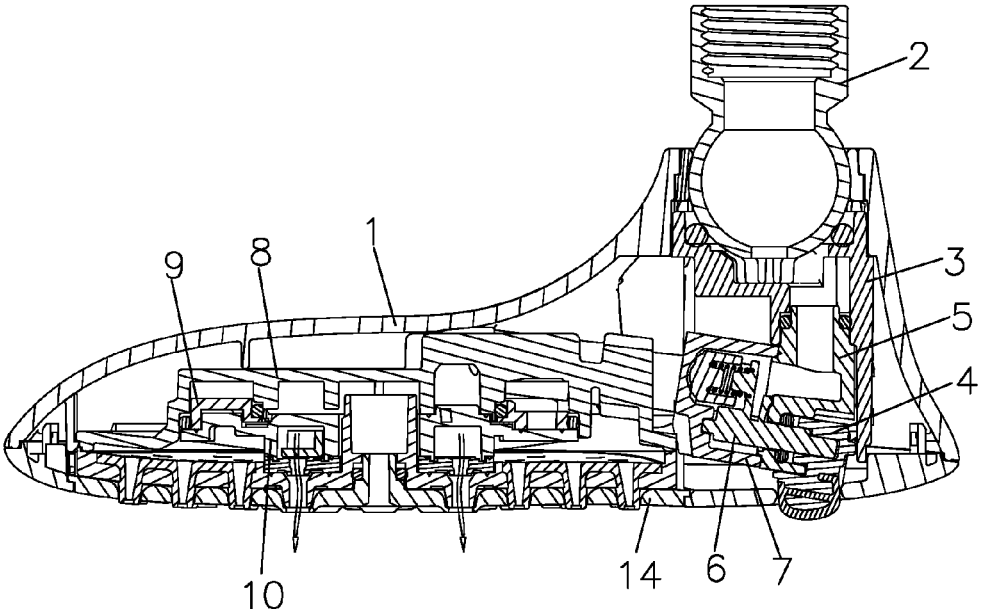
Figures 1, 11:
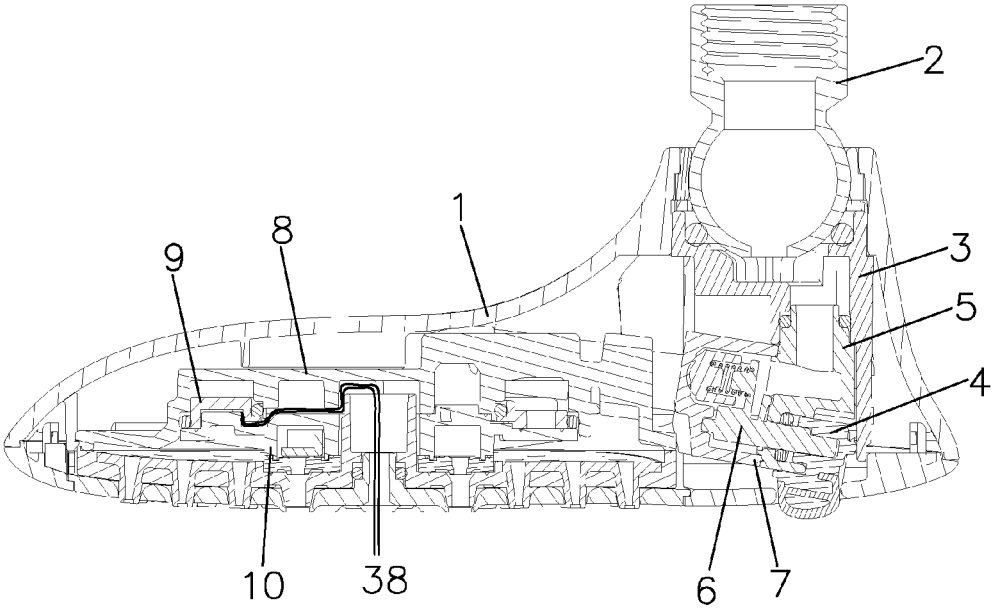
Figures 2, 11:
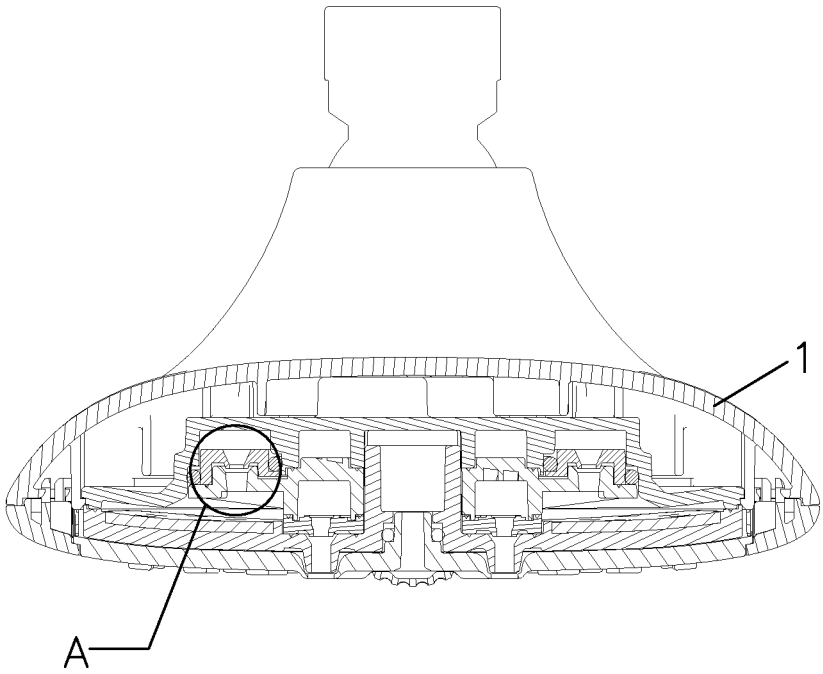
Figures 3, 11:
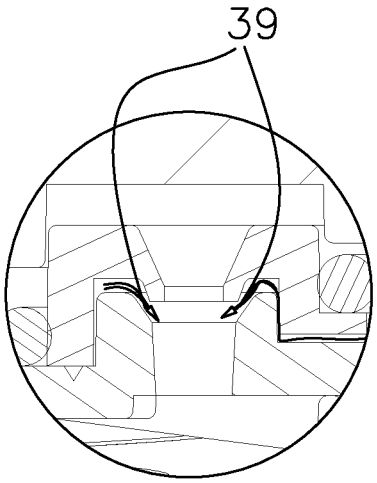
Figure 12:
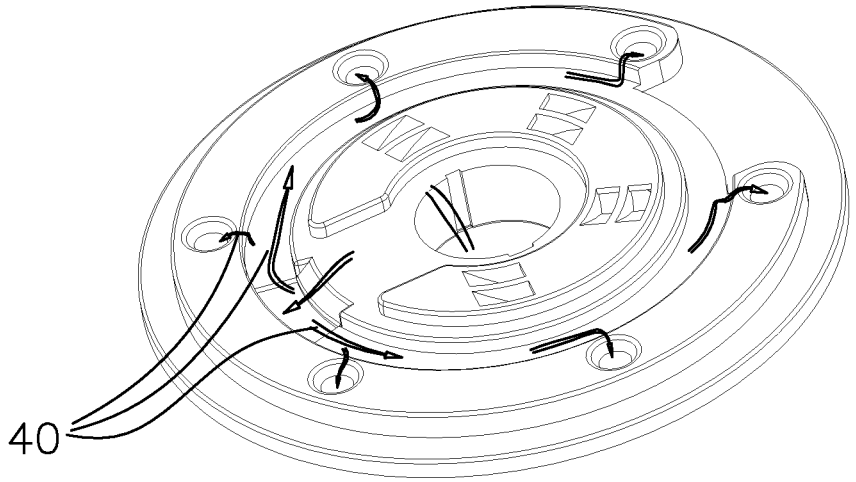
FIG. 12 is a schematic view to show the inclined member.
Figures 1, 13:
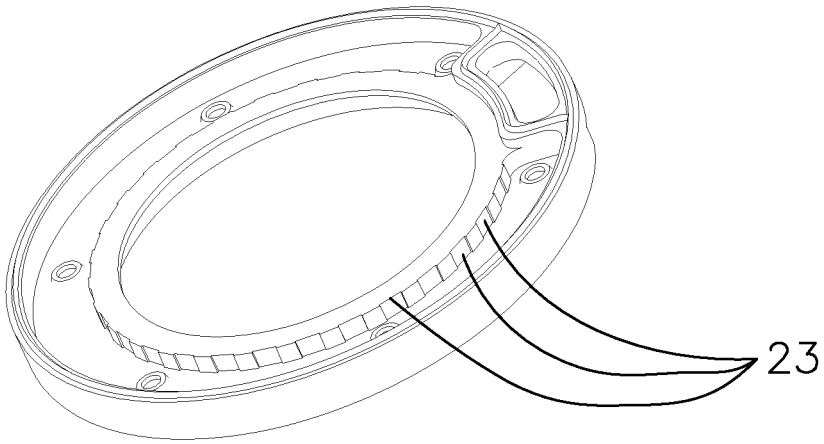
Figures 2, 13:
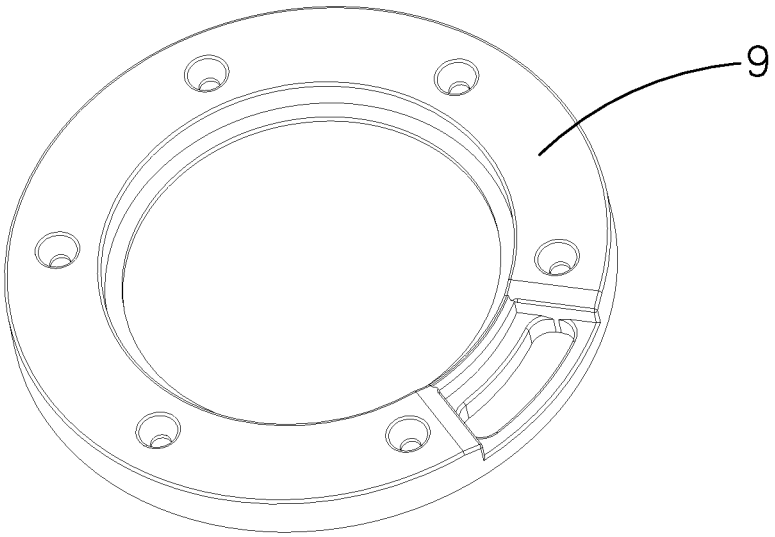
Figures 1, 14:
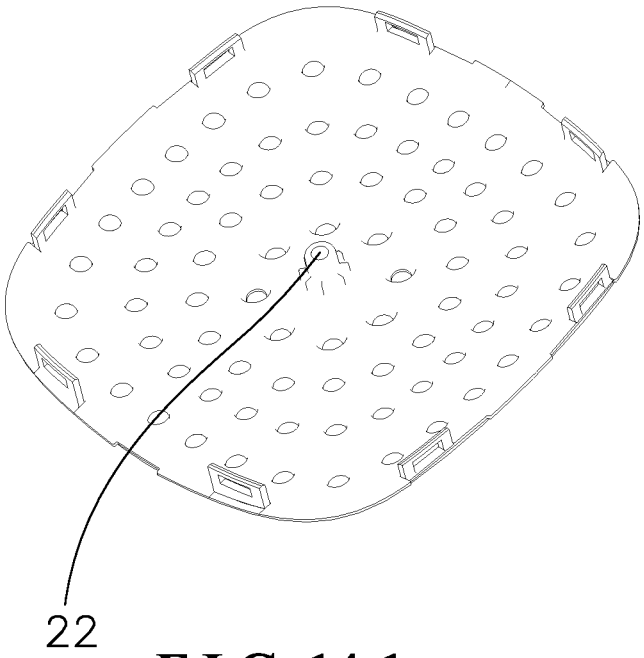
Figures 2, 14:
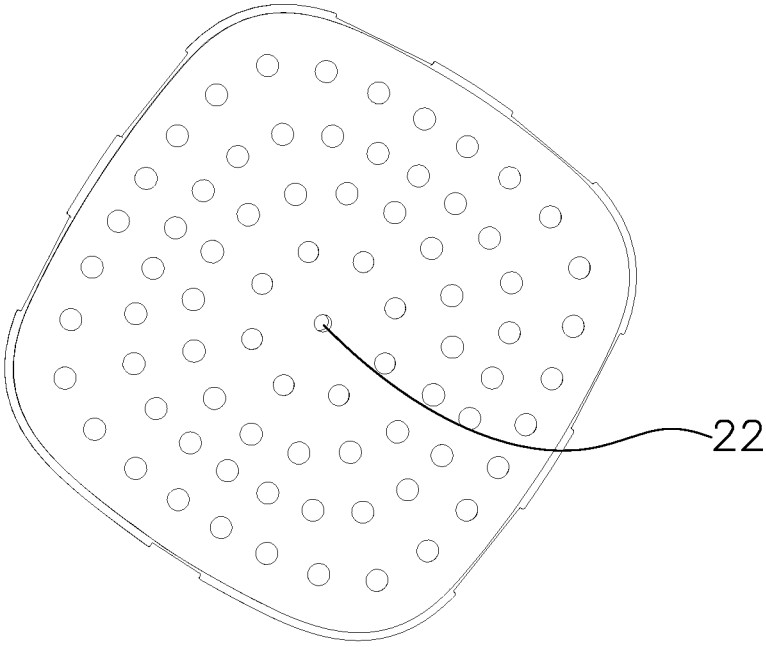
Figures 3, 14:
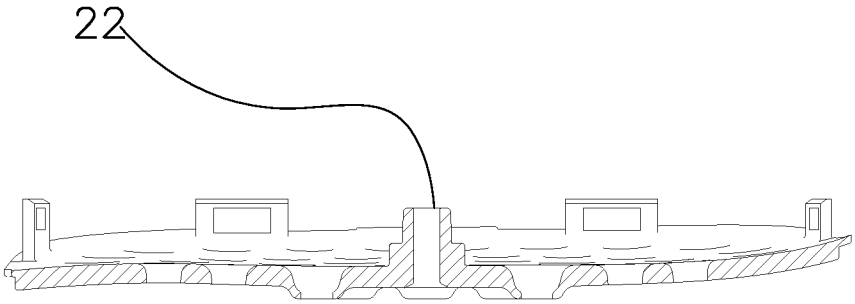
Figures 1, 15:
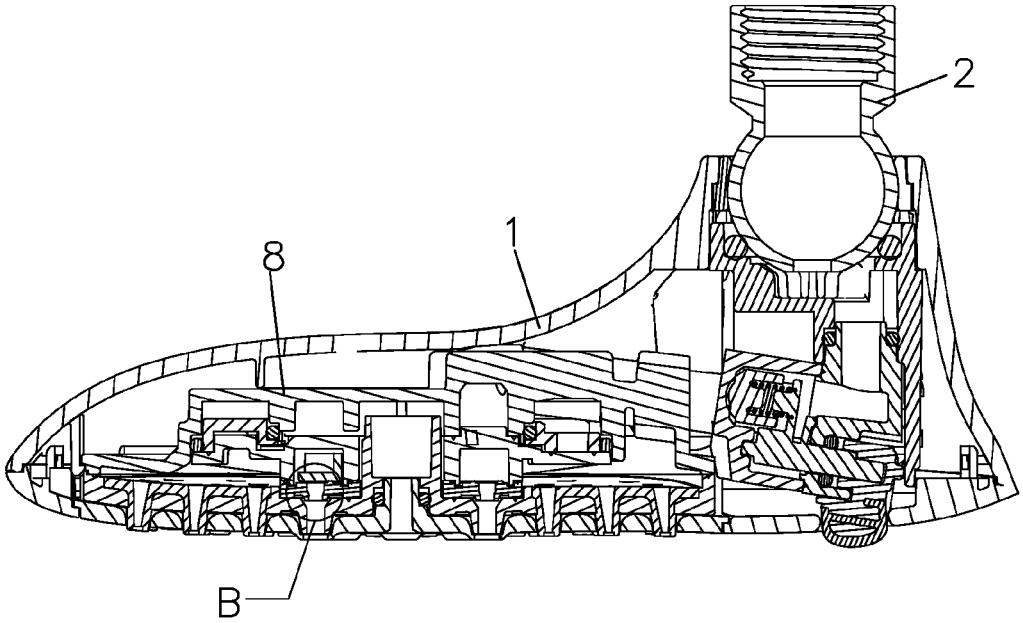
Figures 2, 15:
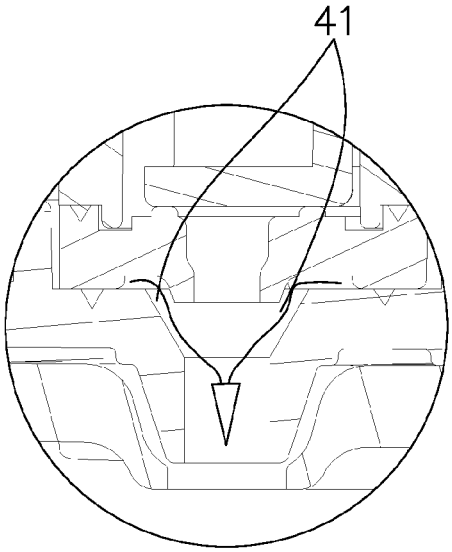
Figure 16:
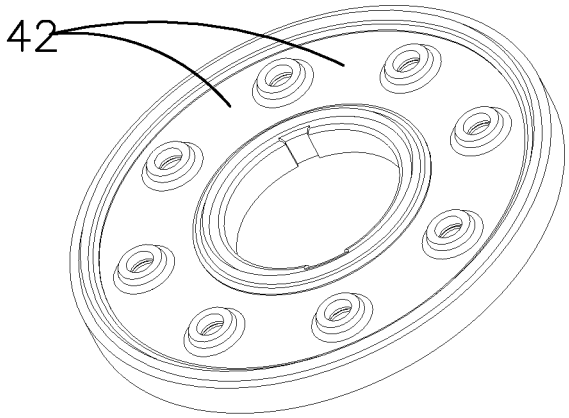
FIG. 16 is a schematic view to show the air intake valve.
Figures 1, 17:
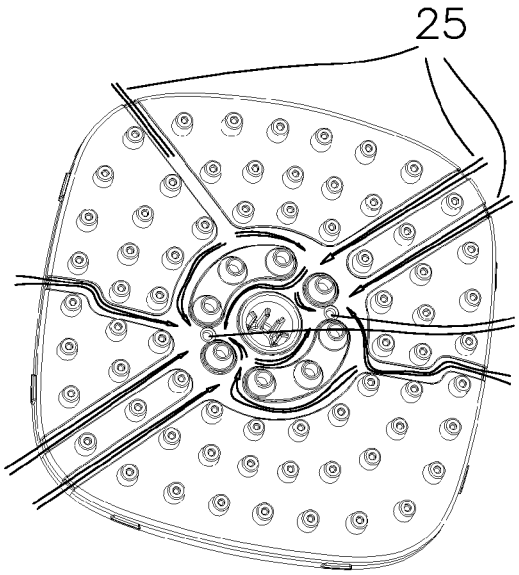
Figures 2, 17:
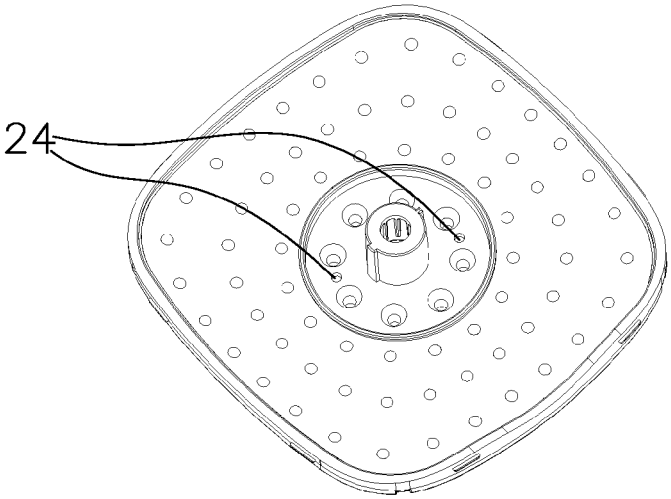

As shown in FIGS. 1 to 3, FIG. 4-1, FIG. 4-2, FIG. 5-1, FIG. 5-2, FIG. 6-1, FIG. 6-2, FIG. 7-1, FIG. 7-2, FIG. 8-1, FIG. 8-2, FIG. 9-1, FIG. 9-2, FIG. 10-1, FIG. 10-2, FIG. 11-1, FIG. 11-2, FIG. 11-3, FIG. 12, FIG. 13-1, FIG. 13-2, FIG. 14-1, FIG. 14-2, FIG. 14-3, FIG. 15-1, FIG. 15-2, FIG. 16, FIG. 17-1, FIG. 17-2, the shower head of the present invention comprises a shower head body 1, a spherical joint 2, a fixing seat 3, a TPR roller 4, a welding sheet 5, a switching shaft 6, a connecting member 7, a water dispensing disc 8, a supporting frame 9, an inclined member 10, a rotor 11, an air intake valve 12, a TPR lid 13, and a cover 14. The switching shaft 6 is a concave body with a handle. A cylinder 15 having a hole is provided in the concave body. A spring 16 and a sealing gasket 17 are sleeved on the cylinder 15. A pillar 18 is arranged on the outer side of the concave body. The pillar 18 is connected with the connecting member 7. The handle of the switching shaft 6 is connected with the welding sheet 5. The sealing gasket 17 of the present invention is a cylinder having a recess to receive a small cylinder 19. The spring is disposed in the recess. The small cylinder 19 is mated with the hole of the cylinder 15 on the switching shaft 6. The top of the welding plate 5 communicates with the fixing seat 3. One side of the bottom of the welding plate 5 is connected with the switching shaft 6, and the other side is connected with the TPR roller 4. The TPR roller 4 has a semicircular shape. The rotating width of one side of the TPR roller 4 is 40 degrees. The connecting member 7 has left and right through holes 20A, 20B and a middle blind hole 21. The two through holes 20A, 20B of the connecting member 7 communicates with the water dispensing disc 8. The cover 14 of the present invention has a central air inhaling hole 22. The supporting frame 9 has a plurality of notches 23 around an inner edge thereof. The inclined member 10 has an air passage 40. The notches 23 communicate with the air passage 40 to form an air inhaling passage of the shower head. The TPR lid 13 has two air inhaling holes 24 thereon. The TPR lid 13 has a plurality of air intake passages 25 at a lower surface thereof to communicate with the two air inhaling holes 24. A gap is defined between the air intake valve 12 the TPR lid 13 to form an air chamber as an air inhaling passage for massage water. As shown in FIG. 1, the present invention further comprises a C-shaped ring 26, O-shaped rings 27, 28, 29, 31, 32, 33, 34, a screw 30, a decoration ring 35. The arrows in the drawing show the direction of the water flow. As shown in FIG. 4-1, the present invention has a shower head water outlet 36, and a massage water outlet 37. FIG. 11-1 shows an air inhaling passage 38. FIG. 11-3 shows a vacuum 39. FIG. 12 shows the air passage 40. FIG. 15-2 shows a vacuum 41. FIG. 16 shows an air chamber 42.

The working principle of the present invention is described as follows.

The principle of the shower head having a roller switch is that the water passes the fixing seat through the spherical joint to enter the welding sheet and switch the water passage. The switching shaft passes through the welding sheet, and then connects with the TPR roller. One notch of the switching shaft is connected with the TPR roller to constitute a limit. The recess of the switching shat is provided with the spring the sealing gasket. One end of the sealing gasket biased by the spring and the connecting member have a compressed force. Thus, the present invention has a better sealing effect when the water pressure is lower because it is sealed by using the spring, and it is easy to switch when the water pressure is higher. The left and right holes of the connecting member are through holes and the middle hole is a blind hole. The left through hole 20A is as the shower head water outlet. The right through hole 20B is as the massage water hole. When the sealing gasket is at the position of the blind hole, the left and right holes are communicated as mixed water (namely, shower head water and massage water). The left and right holes communicate with the two holes of the water dispensing disc, one leading to the shower head water and the other leading to the massage water.

The air inhaling principle of the shower head is that the cover has the air inhaling hole. The inclined member has the air passage. The notch of the supporting frame is as the air intake passage. According to Bermoulli principle, when the water sprays from the water outlet of the supporting frame, the surroundings of the water outlet will form vacuum negative pressure. By the water flow, the air is inhaled to mix with the water to increase oxygen content of the water so as to enhance the comfort of taking a shower.

Massage water inhaling principle is that the TPR lid has the two air inhaling holes thereon, and that the TPR lid has the plurality of air intake passages at the lower surface thereof to communicate with the two air inhaling holes. A gap is defined between the air intake valve the TPR lid to form an air chamber, cooperating with the inclined member and the rotor, to form massage water with oxygen-containing function.

Annotation: TPR (Thermoplastic Rubber) is a material having the properties of rubber and thermoplastic.

Although particular embodiments of the present invention have been described in detail for purposes of illustration, various modifications and enhancements may be made without departing from the spirit and scope of the present invention. Accordingly, the present invention is not to be limited except as by the appended is claims.

What is claimed is:

1. A shower head, comprising a shower head body, a spherical joint, a fixing seat, a TPR (Thermoplastic Rubber) roller, a welding sheet, a switching shaft, a connecting member, a water dispensing disc, a supporting frame, an inclined member, a rotor, an air intake valve, a TPR lid and a cover, the switching shaft being a concave body with a handle, a cylinder having a hole being provided in the concave body, a spring and a sealing gasket being sleeved on the cylinder, a pillar being arranged on an outer side of the concave body, the pillar being connected with the connecting member, the handle of the switching shaft being connected with the welding sheet.

2. The shower head as claimed in claimed in claim 1, wherein the sealing gasket is a cylinder having a recess to receive a small cylinder, the spring is disposed in the recess, and the small cylinder is mated with the hole of the cylinder on the switching shaft.

3. The shower head as claimed in claimed in claim 1, wherein a top of the welding sheet communicates with the fixing seat, one side of a bottom of the welding sheet is connected with the switching shaft, and another side of the bottom of the welding sheet is connected with the TPR roller.

4. The shower head as claimed in claimed in claim 1, wherein the rotating width of one side of the TPR roller is 40 degrees.

5. The shower head as claimed in claimed in claim 1, wherein the connecting member has left and right through holes and a middle blind hole, and the two through holes communicate with the water dispensing disc.

6. The shower head as claimed in claimed in claim 1, wherein the cover has a central air inhaling hole, the supporting frame has a plurality of notches around an inner edge thereof, the inclined member has an air passage, and the notches communicate with the air passage to form an air inhaling passage of the shower head.

7. The shower head as claimed in claimed in claim 1, wherein the TPR lid has two air inhaling holes thereon, the TPR lid has a plurality of air intake passages at a lower surface thereof to communicate with the two air inhaling holes, and a gap is defined between the air intake valve and the TPR lid to form an air chamber as an air inhaling passage for massage water.

* * * * *